US007276708B2

(12) United States Patent
Barov

(10) Patent No.: US 7,276,708 B2
(45) Date of Patent: Oct. 2, 2007

(54) DIAGNOSTIC RESONANT CAVITY FOR A CHARGED PARTICLE ACCELERATOR

(75) Inventor: Nikolai Barov, San Diego, CA (US)

(73) Assignee: FAR-TECH, Inc., San Diego, CA (US)

( * ) Notice: Subject to any disclaimer, the term of this patent is extended or adjusted under 35 U.S.C. 154(b) by 31 days.

(21) Appl. No.: 11/286,240

(22) Filed: Nov. 23, 2005

(65) Prior Publication Data

US 2007/0115071 A1 May 24, 2007

(51) Int. Cl.
*G21K 1/08* (2006.01)

(52) U.S. Cl. ..... 250/396 R; 250/306; 315/5.41

(58) Field of Classification Search ..... 315/3.5, 315/3.6, 4, 5, 5.14, 5.15, 5.16, 5.22, 5.31, 315/5.42, 5.41, 5.52, 500, 501, 505; 250/396 R, 250/396 ML, 398, 400, 306; 313/364, 350, 313/356, 357

See application file for complete search history.

(56) References Cited

U.S. PATENT DOCUMENTS 4,118,653 A * 10/1978 Vaguine ..... 315/5.41
4,494,040 A * 1/1985 Moretti ..... 315/5.41
4,703,234 A * 10/1987 Kato ..... 315/5.41
6,815,688 B2 * 11/2004 Schneiker et al. ..... 250/396 R
6,946,663 B2 * 9/2005 Kawai ..... 250/396 ML
2002/0053638 A1 * 5/2002 Winkler et al. ..... 250/306
2003/0111948 A1 * 6/2003 Retsky ..... 313/364
2003/0168606 A1 * 9/2003 Adamec et al. ..... 250/396 R
2005/0092921 A1 * 5/2005 Nakasuji et al. ..... 250/306
2005/0092929 A1 * 5/2005 Schneiker ..... 250/396 R

OTHER PUBLICATIONS

Leeman, C. et al; "A Highly Effective Deflecting Structure;" Proc of the 1990 LINAC Conference.
Ross, Marc et al; "Very High Resolution RF Cavity BPM;" Proceedings of the 2003 Accelerator Conference; 2003.
Miller, R.H. et al; "Nonintercepting Emittance Monitor;" Proceedings of the 12th Intl. Conf. on High Energy Accerators; 1983, Aug. 11, 1983.
Whittum, D. et al;"Analysis of an Assymetric Resonant Cavity as a Beam Monitor;" *May, 1999*.
Kim, J. S.; "Resonant-Cavity Approach to Noninvasive, Pulse-to-Pulse Emmittance Measurement;" Rev. Scien. Inst. vol. 76(1), 2006, No Date.

(Continued)

*Primary Examiner*—Trinh Dinh
*Assistant Examiner*—Tung Le

(57) ABSTRACT

Disclosed is a diagnostic resonant cavity for determining characteristics of a charged particle beam, such as an electron beam, produced in a charged particle accelerator. The cavity is based on resonant quadrupole-mode and higher order cavities. Enhanced shunt impedance in such cavities is obtained by the incorporation of a set of four or more electrically conductive rods extending inwardly from either one or both of the end walls of the cavity, so as to form capacitive gaps near the outer radius of the beam tube. For typical diagnostic cavity applications, a five-fold increase in shunt impedance can be obtained. In alternative embodiments the cavity may include either four or more opposing pairs of rods which extend coaxially toward one another from the opposite end walls of the cavity and are spaced from one another to form capacitative gaps; or the cavity may include a single set of individual rods that extend from one end wall to a point adjacent the opposing end wall.

16 Claims, 6 Drawing Sheets

OTHER PUBLICATIONS

Kim, J. S.; "Design of a Standing-Wave Multicell Radio Frequency Cavity Beam Monitor for . . . Emittance Measurement;" Rev Sci Inst 76(1), 2005.

Barov, Nikolai; "High-Precision Resonant Cavity Beam Position, Emittance and Third-Moment Monitors;"unpublished as of Nov. 23, 2005.

* cited by examiner

DIAGNOSTIC RESONANT CAVITY FOR A CHARGED PARTICLE ACCELERATOR

STATEMENT REGARDING FEDERALLY SPONSORED RESEARCH OR DEVELOPMENT

This invention was made with Government support under Grant No. DE-FG02-03ER83658 awarded by the Department of Energy. The Government has certain rights in this invention.

FIELD OF THE INVENTION

The present invention relates generally to electrically resonant cavities, and in particular to resonant cavities of the type used in electron beam and other charged particle accelerators.

BACKGROUND OF THE INVENTION

The invention described and claimed herein has application to accelerators used to produce charged particle beams, primarily electron beam accelerators. While the present invention is described herein primarily with reference to electron beam accelerators, the invention also has application to accelerators designed to produce beams of protons or other charged particles.

All of the references cited herein are hereby incorporated by reference.

In most charged particle accelerators there is a need to determine the size, position, cross-sectional shape, and other characteristics of the beam of charged particles produced by the accelerator, usually at various points along the path of the beam as it is accelerated along an evacuated beam tube. Such a determination is necessary in order to enable appropriate adjustments to be made to the structures and operating parameters of the accelerator, for the purpose of optimizing the size, shape, position and other characteristics of the beam.

Since the particles constituting the beam are electrically charged, they interact with an electrically resonant cavity interposed along the beam path. This interaction provides the basis for accelerating the particles, by applying a radio frequency signal to the cavity from an external source. In this regard, a particle beam accelerator will typically have a substantial number of resonant cavities, up to hundreds or thousands, positioned in sequence along the beam path. The purpose and function of each such cavity is to accelerate the particles as they pass through the cavity. At each stage additional energy is imparted to the charged particles, to the extent that in an electron beam accelerator the electrons are typically accelerated to a velocity that is a substantial fraction of the speed of light.

Acceleration is not the only use of resonant cavities in a particle accelerator. The interaction between the charged particles and any resonant cavity through which they pass also provides a basis for using a resonant cavity as a diagnostic tool, for determining the size, shape and other characteristics of the beam as it passes along the beam line; and it is to this purpose that the present invention is directed.

An electrically conductive structure acts as a resonator, or oscillator, when it has appropriate capacitative and inductive elements electrically connected in series in a loop. A simple oscillator can consist of an inductor and a capacitor connected to one another so as to form closed electrical loop. Resonance of such a circuit consists of alternating accumulations of an electric field in the capacitor and a magnetic field in the inductor. The frequency at which such an oscillator resonates is determined by the inductance (L) of the inductor and the capacitance (C) of the capacitor. Such a circuit is known as an LC network and its resonant frequency is given by the formula:

$$f = \frac{1}{2\pi\sqrt{LC}}$$

A conductive structure as simple as a hollow tube that is closed at both ends can act as a resonant oscillator, and such an oscillator is known as a resonant cavity. In the ideal case of a cylindrical tube closed at both ends by parallel end plates, the spaced apart, parallel end plates act as a capacitor and the cylindrical wall of the tube acts as a single-turn inductor. In such a structure the periodic accumulation, discharge, and reversal of an axially extending electrical field, which extends between the capacitative end plates, alternates 90 degrees out of phase with the accumulation, discharge and reversal of a circular magnetic field that is centered on and extends along a circular path around the axis of the cylindrical tube, and which is largely contained within the cylindrical walls of the tube. The full cycle of the reversing electrical and magnetic fields repeats at the resonant frequency of the cavity.

Electrical energy can be introduced into such a cavity in the form of an RF signal transmitted into the cavity through a waveguide, to thereby maintain the cavity in a continuously resonant mode by overcoming ordinary losses due to power dissipation in the LC circuit.

In a charged particle accelerator, beams of charged particles, typically electrons or protons, are formed and are accelerated along a beam path. As noted above, resonant cavities are used to accelerate the particles in such beams. In such accelerators an evacuated beam tube defines a beam line that extends axially through multiple, spaced resonant cavities that are positioned along the beam line. The charged particles are accelerated in bunches as they pass through the successive resonant cavities. Each cavity must be appropriately positioned along the beam path and its interaction with the charged particles must be appropriately timed and otherwise optimized in several respects to achieve effective acceleration of the charged particles.

In particular, at each cavity the periodic formation of the electrical field must be properly phased and timed so that both its direction and its maximum strength coincide with the arrival of a bunch of charged particles at the center of the cavity. Further, the axial length of the particle bunch must be short compared with the wavelength of the RF signal used to excite the cavity. Finally, the axial length of the cavity in the direction of the beam must be sufficiently short that the electrical field extends in the same direction during the entire time required for the particle bunch to pass through the cavity.

A continuing challenge in the design and operation of particle accelerators is the determination of the precise characteristics of the particle beam at various points along the beam path. Such characteristics as the beam current, the cross-sectional shape of the beam, and the position of the beam relative to the axis of the beam tube are all affected by multiple factors related to the physical characteristics of the particle source and the beam line, including its accelerating cavities, as well as the operating parameters of the accelerator.

The ability to accurately and precisely diagnose the characteristics of the particle beam at various points is necessary in order to make the operating adjustments that are in turn required to optimize the quality of the beam. For this purpose, diagnostic resonant cavities may be interposed in the beam line at various points. Diagnostic cavities resonate in a manner similar to the resonance of the accelerating cavities. However, in the case of a diagnostic cavity the charged particle beam passing through the cavity generates a signal which can be transmitted out of the cavity through an appropriate waveguide. The nature and strength of this signal depend on the intensity, shape and position of the particle beam and thus can be used for diagnostic purposes.

Various techniques have been used to monitor the characteristics of a particle beam. See for example J. Ross et al., "Very High Resolution RF Cavity BPM" (beam position monitor), Proceedings of the 2003 Particle Accelerator Conference, p. 2545. A cavity intended as a beam position monitor is characterized by a voltage pattern which is, for example, positive in one side of the cavity and negative in the opposite side of the cavity. Such a cavity is useful for measuring the average displacement of the particle beam to one side of the cavity or the other.

As another example, a method of measuring the quadrupole moment of a beam with stripline beam position monitors for the purpose of determining the beam emittance was developed by Miller et al. (R. H. Miller, J. E. Clendenin, M. B. James, J. C. Sheppard, Proc. 12$^{th}$ Int. Conf. On High Energy Acc. (Fermilab, Batavia, 1983), SLAC-PUB-3186). In a related method, Whittim and Kolomensky disclosed the concept of using a resonant cavity to measure the beam dipole, quadrupole and higher moments. (D. H. Whittum and Y. K Kolomensky, Rev. Sci. Instr. 70 (1999), p 2300.) The idea of using a resonant cavity to measure the beam quadrupole moment was further developed by Kim et al. (J. S. Kim, C. D. Nantista, R. H. Miller, A. W. Weidemann, "A Resonant Cavity Approach to Non-Invasive Pulse-to-Pulse Emittance Measurement," submitted to Rev. Sci. Instr.) The use of a cavity mode to measure the beam quadrupole moment has a much better signal to noise ratio than either the stripline or button pickup techniques, and can be used to measure much smaller beam features. In a quadrupole mode, the cavity is split into four quadrants, such that the cavity voltage alternates between positive and negative between adjacent quadrants and the cavity voltage is proportional to $x^2-y^2$.

The quadrupole-mode cavity measures $\langle x^2-y^2\rangle=\sigma_x^2-\sigma_y^2+\langle x\rangle^2-\langle y\rangle^2$, where the angle brackets (< >) indicate an average over the particle beam population. Nearby dipole cavities measuring <x> and <y> can be used to subtract the two rightmost terms from this expression in order to give a measurement of $\sigma_x^2-\sigma_y^2$, where $\sigma_x$ and $\sigma_y$ are the root mean square beam widths in the x and y directions, respectively. In the absence of beam coupling between the x and y phase spaces, an emittance measurement can be performed by measuring the quadrupole moment at six locations along the beamline interspersed along the beamline focusing elements. Also, another cavity can be tilted by 45 degrees to measure <xy>, which can be used to diagnose and correct coupling between the x and y beam dimensions.

Quadrupole-mode beam position monitor cavities typically generate a much weaker signal than dipole-mode beam position monitor cavities. In order to make accurate measurements of low-emittance, high-energy beams, the measurement cavity should be optimized as much as possible. One way to improve measurement sensitivity is to use a multi-cell standing-wave cavity, for example a 9-cell structure as disclosed by J. S. Kim et al. (J. S. Kim, R. H. Miller, C. D. Nantista, "Design of a Standing-Wave Multi-Cavity Beam-Monitor for Simultaneous Beam Position and Emittance Measurement," Rev. Sci. Instr. 76, 1 (2005)). In the disclosure of Kim et al., the shunt impedance as a function of beam offsets x and y is approximately $R\approx 800\,(x^2-y^2)_2\ \Omega$, where x and y are in units of millimeters. We define the shunt impedance as $R=V^2/P$, where V is the voltage gained by a relativistic particle crossing a cavity containing a reference mode, and P is the power dissipated in the cavity walls. For a high-current train of pulses such as is expected to be used in future collider designs, such a diagnostic can adequately resolve the quadrupole moment of a beam with $\sigma_x=1$ μm, and $\sigma_y<<\sigma_x$. In order to make an accurate measurement in this case, the beam should be relatively close to the cavity axis, within a few microns.

Multi-cell structures are, however, more difficult to fabricate and tune. In order to obtain adequate shunt impedance for the mode, the structure is typically designed to operate in the π-mode. However, improper cell-to-cell transverse alignment can couple power to all modes in the quadrupole band, with phase advance ranging from 0 to π. (N. Barov, J. S. Kim, A. W. Weidemann, R. H. Miller, C. D. Nantista, "High-Precision Resonant Cavity Beam Position, Emittance and Third-Moment Monitors," Proc. of the 2005 Particle Accelerator Conference.) This power must eventually be filtered out, which is more difficult in the case of small inter-mode spacing.

A resonant cavity incorporating two conductive rods extending into the cavity has been disclosed as having an approximately 100-fold increase in shunt impedance and has been suggested as being useful primarily as a beam deflector, and incidentally as a potential dipole-mode beam position monitor. (C. Leemann and C. G. Yao, "A Highly Effective Deflecting Structure," Proceedings of the 1990 Linac conference, p. 232.) However, beam deflection in any particular direction requires only a dipole-mode structure, and thus there is no suggestion in the disclosure of Leemann and Yao of applications of more complex cavities based on higher-order resonant modes. Moreover, when the cavity of Leeman and Yao is optimized to function as a high-frequency (>5 GHz) diagnostic cavity with a reasonably large beam tube diameter, the effect of the rods is greatly diminished. For example, an 8.6 GHz cavity with a 1 cm diameter beam tube and the two rods of Leeman and Yao produces only approximately 40% more output power than a comparable cavity without the rods. Consequently beam position monitors based on resonant cavities and designed for electron accelerators operating at higher frequencies have consisted of simple resonant cavities without the two conductive rods suggested by Leeman.

In this regard, many electron accelerators operate with very short electron bunches, on the order of 10 picoseconds or less. In order to maximize the cavity output signal of such an accelerator, the diagnostic cavity frequency should be as high as possible, yet while also maintaining the condition that the cavity field should not change appreciably during the time period of the electron bunch. This favors a cavity frequency of at least 5 GHz.

For these reasons the two-rod cavity design of Leeman and Yao has not found acceptance as a beam position monitor, and there is nothing in the Leeman and Yao disclosure to suggest that increasing the number of rods would improve the performance of the cavity as a diagnostic cavity.

Accordingly, it is the object and purpose of the present invention to provide a resonant cavity that is useful for measuring and diagnosing the characteristics of a charged particle beam produced in a charged particle accelerator.

More particularly, it is the object and purpose to provide an improved apparatus and method for measuring the cross-sectional shape and dimensions of a charged particle beam.

SUMMARY OF THE INVENTION

The present invention provides a diagnostic resonant cavity for use in determining characteristics of a charged particle beam traveling along a beam line of a charged particle accelerator. The cavity includes two electrically conductive, opposing end walls that are spaced apart from one another by an electrically conductive tubular wall. The walls have centered openings for interposition of the cavity in the beam line of an accelerator by connection to a beam tube, wherein the longitudinal axis of the beam tube defines the nominal path of travel of the charged particle beam. The cavity further includes an even plurality of at least four pairs of electrically conductive rods extending inwardly into the cavity from the end walls, with each pair of rods consisting of two rods that extend inwardly and coaxially toward one another from the two opposing end walls, in a direction parallel to the axis of the beam tube. The rods of each pair of rods are spaced from one another so as to form a capacitative gap between one another. The pairs of rods are equally spaced azimuthally in a symmetrical array around the central longitudinal axis of the beam tube.

The rods effectively increase the shunt impedance of the cavity and thus increase the strength of a resonance signal emitted from the cavity upon passage of a particle beam through the cavity. Increased signal strength enables increasingly accurate determinations of the shape of the particle beam passing through the cavity.

Cavities having higher order resonant modes, for example, a cavity based on a sextupole mode and utilizing six pairs of spaced rods, are also useful for attaining more detailed information on the cross-sectional shape of the beam passing through the cavity.

In another embodiment of the invention, the cavity includes an even plurality of at least four rods which extend from only one end wall of the cavity, for a length greater than the major fraction of the length of the cavity, and which are equally spaced azimuthally in a symmetrical array around the central longitudinal axis of the beam tube.

These and other aspects of the invention will be more apparent upon consideration of the accompanying drawings, taken with the following detailed description of preferred embodiments.

BRIEF DESCRIPTION OF THE DRAWINGS

The accompanying drawings form a part of and are incorporated into this specification.

In the drawings.

Figure 1:
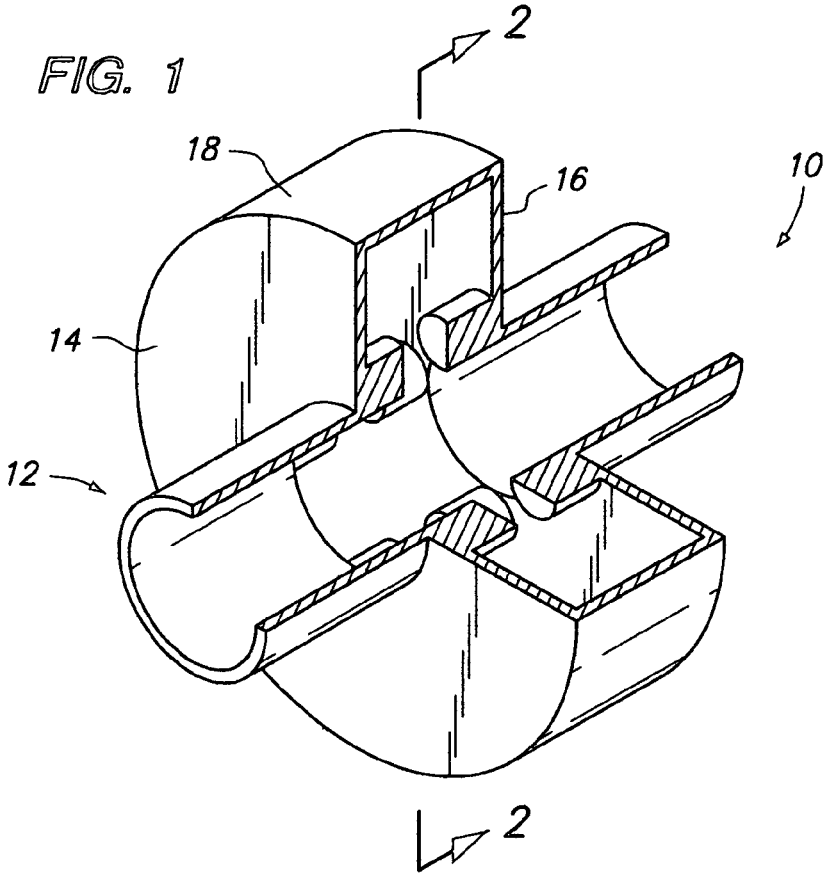
FIG. 1 is a an isometric view in partial cross section of a resonant cavity constructed in accordance with a preferred embodiment of the invention.

The drawings constitute part of this specification and are best understood with reference to the following detailed description of the invention.

DETAILED DESCRIPTION OF THE INVENTION

The term "resonant cavity" is used herein to mean a hollow electrically resonant structure that defines an interior volume through which a charged particle beam may be passed.

The electrons in high-energy research electron accelerators travel at nearly the speed of light and are bunched in time so that the bunch duration is only a small fraction of the period of one oscillation of the resonant cavities through which the electrons pass. The electron beam may be made up of many such bunches spaced at a regular time interval, or it may consist of a single bunch of electrons.

As noted above, the electric and magnetic fields within a resonant cavity oscillate at frequencies that are determined by the capacitance and inductance of the cavity. A resonant cavity typically has many harmonic resonances, or modes, each of which must be considered separately. A mode is characterized by the voltage it can impart to a charged particle traveling generally parallel to the beam tube axis but offset by some distance from the beam tube axis. That voltage will be distributed over the cross sectional area of the cavity in a pattern that is a function of the transverse coordinates perpendicular to the beam direction. If the pattern is a dipole, with for example a positive voltage in the left half of the cavity and a negative voltage in the right half, it can be used to diagnose an offset of the beam position from one side of the cavity to the other. If a greater portion of the beam overlaps with the voltage pattern of the positive region than that of the negative region, there is a net positive interaction and power is deposited into the cavity. If there is a net negative interaction, power will be deposited with the opposite phase.

A single electron bunch passing through a cavity with no resonating RF field will deposit energy in several modes according to the overlap with the voltage profile of each mode. This energy can be coupled out of the cavity into an external circuit by means of a conventional waveguide connected to the cavity. Only some of the modes, typically one or two of them, will be required for making the measurement, and the remaining modes may be suppressed. This can be done with a well-known combination of coupler design and filtering.

Diagnostic cavities can be used in either a single bunch or a bunch train mode of accelerator operation. In single bunch operation the cavity is initially free of microwave energy, and interaction between the electron bunch and the cavity deposits a particular amount of energy into the cavity, which can then be measured.

In bunch train operation, a series of bunches passes through the cavity, such that the bunch repetition frequency is a subharmonic of the cavity frequency and microwave energy is resonantly accumulated in the cavity. In bunch train operation the power coupled out of the cavity is proportional to the shunt impedance R of the cavity, and this parameter serves as the figure of merit in bunch train operation. In single bunch operation, the detected microwave signal is generally proportional to R/Q, where Q is known as a quality factor and is defined as the ratio of the energy stored in the cavity to the average energy dissipated in the cavity during one radian (approximately 57 degrees) of cavity oscillation. In single bunch operation there is the concern that too low a value of Q can diminish the efficiency with which the deposited energy is coupled to the waveguide.

Figure 2:
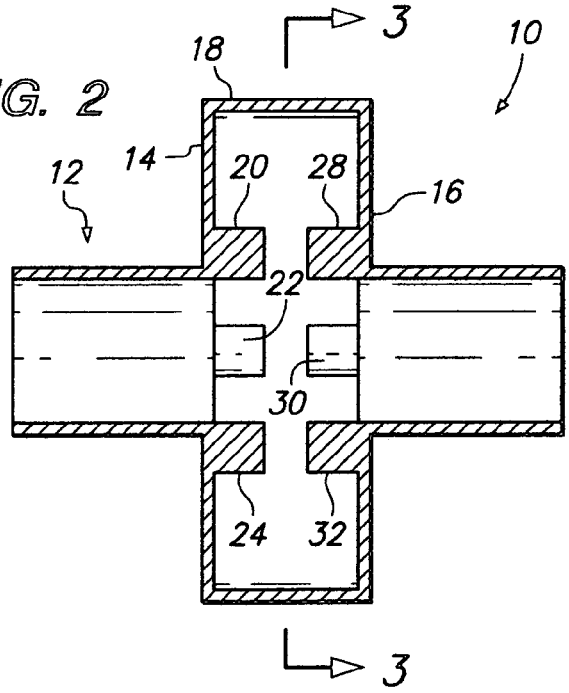
FIG. 2 is a side view of the resonant cavity of FIG. 1.
Figure 3:
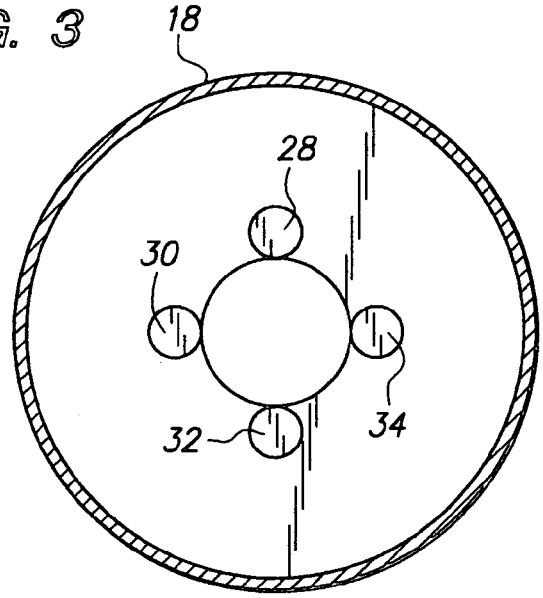
FIG. 3 is an end view in cross section of the resonant cavity of FIG. 1.

FIGS. 1 through 3 illustrate a preferred embodiment of a quadrupole resonant cavity 10 constructed in accordance with the present invention. The cavity 10 is interposed in a beam tube 12 having a diameter of approximately 1.0 cm and a resonant frequency of 11.424 GHz. The cavity 10 has parallel end walls 14 and 16 which are connected by a cylindrical outer wall 18. The axis of the beam tube 12 is centered on the end walls 14 and 16 and is coaxial with the axis of the cylindrical cavity wall 18. The cavity 10 includes four solid metallic rods 20, 22, 24 and 26, which extend inwardly from end wall 14, and four identical rods 28, 30, 32 and 34, which extend inwardly from end wall 16 in opposition to rods 20–26. Rods 20–26 and 28–34 are coaxial with one another, respectively, and are spaced apart to form a capacitative gap between them. In the illustrated embodiment the diameter of the cylindrical cavity wall 18 is approximately 3 centimeters and the spacing between the end walls 14 and 16 is approximately 1 centimeter. The rods 20 through 34 are approximately 3 millimeters in length and approximately 2 to 3 millimeters in diameter. They are preferably positioned as illustrated so as to be tangential to the beam tube 12. The four pairs of rods 20–26 and 28–34 are positioned azimuthally equidistantly around the beam tube 12 and form capacitative gaps which are aligned with the areas of highest voltage magnitude in the quadrupole pattern.

The cavity shunt impedance R of a cavity such as that shown in FIGS. 1 through 3 is optimized by selecting the length and diameter of the rods 20 through 34, along with the length and diameter of the cylindrical wall 18 of the cavity 10. Although a cavity having a cylindrical outer wall 18 is illustrated, the outer wall may have a square, octagonal, or any other tubular cross section. The cross sectional shape of the outer wall has an influence on the frequencies of the remaining cavity modes.

The optimum rod length for the cavity 10 illustrated in FIGS. 1 through 3 has been determined by numerical modeling of the field conditions within the cavity 10. For different rod lengths, the cavity outer wall 18 is adjusted so that the quadrupole mode resonant frequency is maintained at 11.424 GHz.

Figure 4:
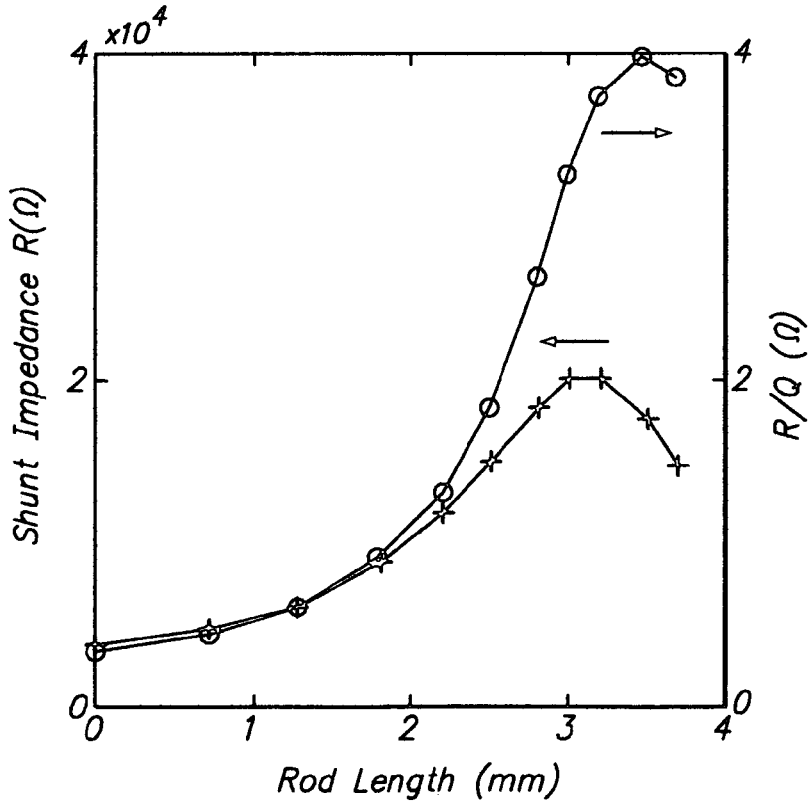
FIG. 4 is a plot of shunt impedance as a function of rod length for a particular quadrupole-based cavity constructed in accordance with the present invention, measured at a position corresponding to x=2.5 mm and y=0 mm.

As FIG. 4 indicates, the shunt impedance R rises quickly as a function of the rod length until the rod length reaches approximately 3.2 mm, and then rapidly diminishes at greater rod lengths. Rod lengths greater than approximately 3.2 mm correspond to cavity geometries where the diameter of the outer wall 18 is too small, i.e., less than approximately 1.26 cm. The maximum shunt impedance for an embodiment as shown in FIGS. 1 through 3 is approximately 5.3 times larger, and the maximum R/Q value is approximately 11.5 times larger, that of a bare cavity having the same resonant frequency, but not having the rods 20 through 34.

Figure 5:
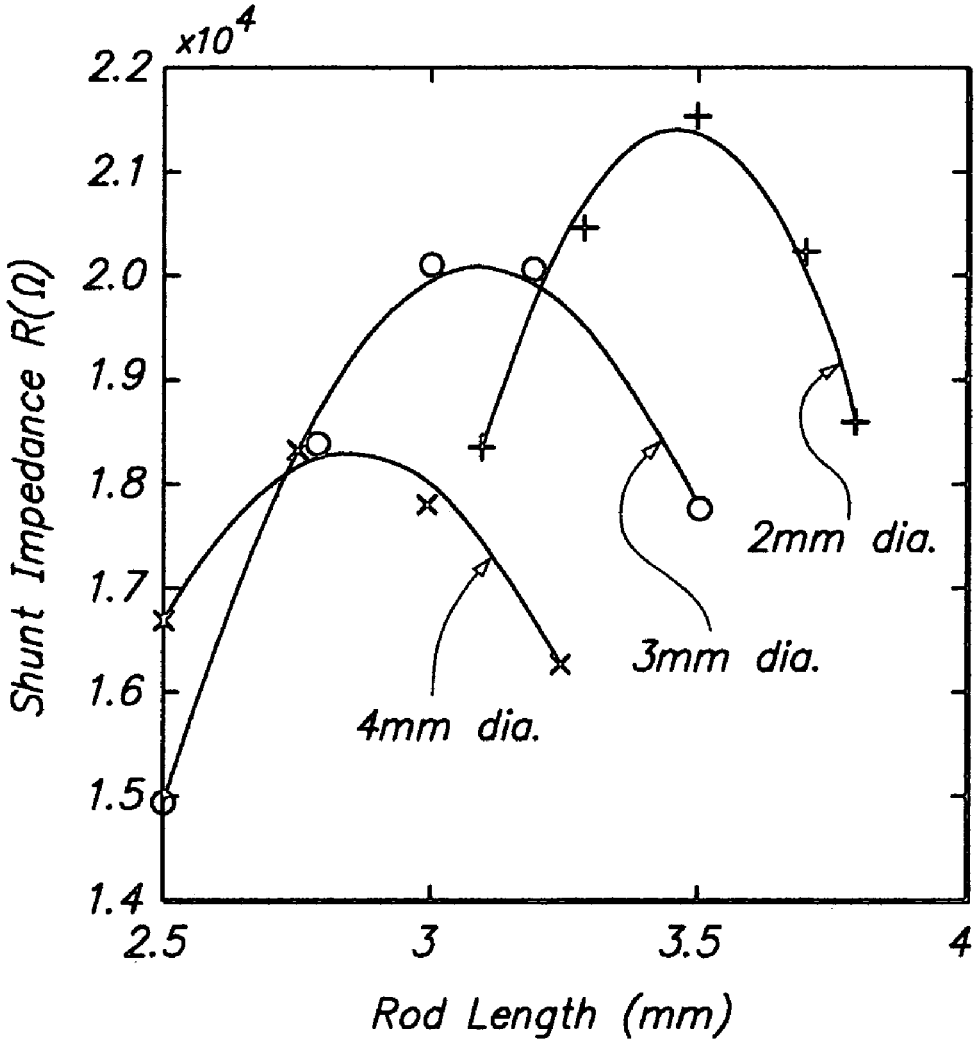
FIG. 5 is a plot of shunt impedance as a function of rod length for rods of several different diameters and a cavity having particular dimensions.

The effect of rod diameter on shunt impedance of the cavity has also been determined by numerical modeling, and is illustrated in FIG. 5. For each of the several diameters listed in FIG. 5, the optimum shunt impedance R occurs at a different value of the rod length. The outer wall diameter of each cavity configuration was again adjusted to reach the target 11.424 GHz resonance frequency. Although the 2 mm diameter rods outperform the 3 mm rods in terms of enhanced shunt impedance by about 5%, the larger diameter 3 mm rods are preferred because of greater ease of fabrication.

The shunt impedance R can be further optimized by adjusting the cavity length, as measured by the length of the cylindrical wall 18. The shunt impedance R at each value of cavity length is optimum near the same value of the cavity outer radius of wall 18, so simulations were performed at a fixed outer radius of 1.77 cm and the cavity frequency was corrected by altering the length of the rods. By this technique the optimum length of the cavity is determined to be approximately 1.1 cm.

The primary effect of the rods of the embodiment shown in FIGS. 1 through 3 is to increase the shunt impedance R and thereby increase the strength of the output signal. However an unintended consequence of the rods is to concentrate the electric field locally so that it deviates from a pure quadrupole pattern. For a beam greater than about 1 mm in radius, this has the undesirable consequence that the resulting output signal represents a combination of the beam quadrupole moment as well as the dodecapole, or 12-pole moment, of the beam. However, so long as the beam confined within a 1 mm radius, which is usually the case, these undesirable higher order moments are negligible.

The performance of a quadrupole-mode cavity is partly determined by the spacing between the desired mode, and the remaining cavity modes. Analysis of a rectangular pillbox cavity by Kim et al. indicates that a combination of $TM_{310}$ and $TM_{130}$ modes can couple on-axis. (J. S. Kim, C. D. Nantista, R. H. Miller, A. W. Weidemann, "A Resonant Cavity Approach to Non-Invasive Pulse-to-Pulse Emittance Measurement." submitted to Rev. Sci. Instr.) These modes tend to be close in frequency at 12.6 GHz and 13.4 GHz, and the tail of the frequency distribution can extend to 11.424 and thus limit resolution.

For a cavity 10 as illustrated, the fundamental mode is at 5.6 GHz, and the dipole modes are at 8.7 GHz. A TE-like mode appears at 13.8 GHz, but will not couple for a beam propagating parallel to the cavity axis. The orthogonal quadrupole mode with electric field maxima rotated 45 degrees from the posts is at 14.2 GHz. With slightly larger rods and smaller cavity outer radius, this mode can easily be made to resonate at >18 GHz if needed. The mode which corresponds to a $TM_{200}$ mode in a cylindrical cavity occurs at 15 GHz. The frequency of this mode can also be increased, if needed.

The signal generated by interaction of a particle beam with the resonant field in the cavity 10 can be transmitted out of the cavity 10 through a conventional waveguide assembly, which is well known and is not further described here.

The optimization of shunt impedance and R/Q has been determined as a function of several cavity parameters, but with a fixed beam tube radius. Some further optimization may be possible by rounding both inside and outside corners of the cavity, canting the end faces of the rods, and optimizing the cross-sectional shape of the rods.

In the case of a quadrupole cavity with four gaps, errors in rod length and placement can result in frequency shift and mode translation, as well as a baseline (monopole-like) shift in the mode pattern. The mode sensitivity to cavity geometry is also subject to fabrication variations.

As noted above, a cavity geometry similar that disclosed in FIGS. 1 through 3, but with only two pairs of rods, was suggested by Leemann and Yao for the purpose of using a 500 MHz dipole mode cavity as a beam deflector. The geometry of the Leeman and Yao structure essentially consists of putting two quarter-wave resonators side-by side. Such a cavity design has an approximately 100-fold increase in shunt impedance. The disclosure of Leeman and Yao suggests that such a design can also be used for the purpose of making a beam position monitor cavity. However, when such a design is applied to a high-frequency (>8 GHz) beam position monitor cavity with a sufficiently large beam pipe (>1 cm), the 100-fold improvement in shunt impedance observed at lower frequencies diminishes almost entirely, to around 40%.

Figure 6:
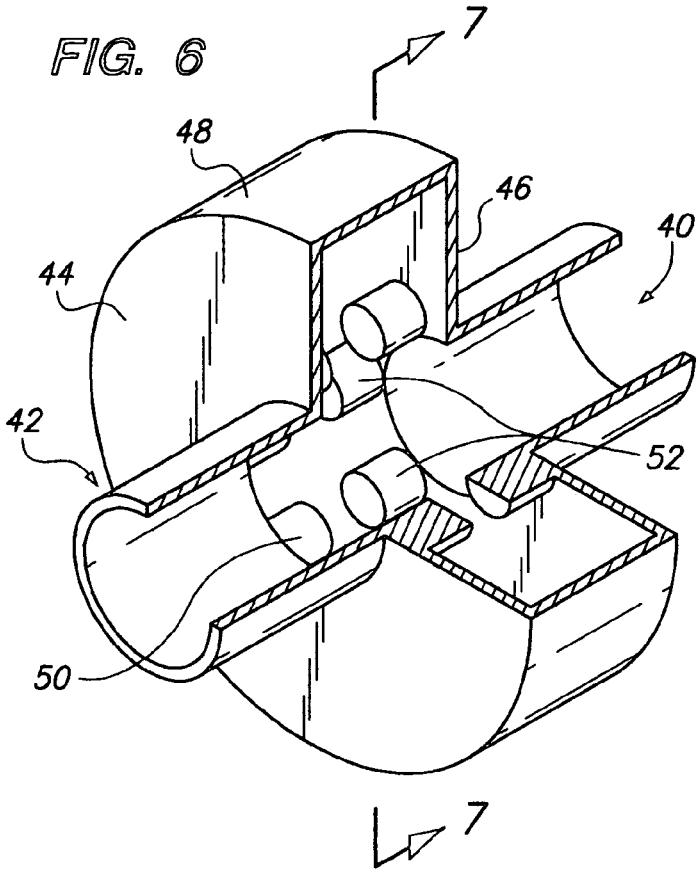
FIG. 6 is an isometric view in partial cross section of a resonant cavity of the present invention having six pairs of spaced rods positioned around the beam tube.
Figure 7:
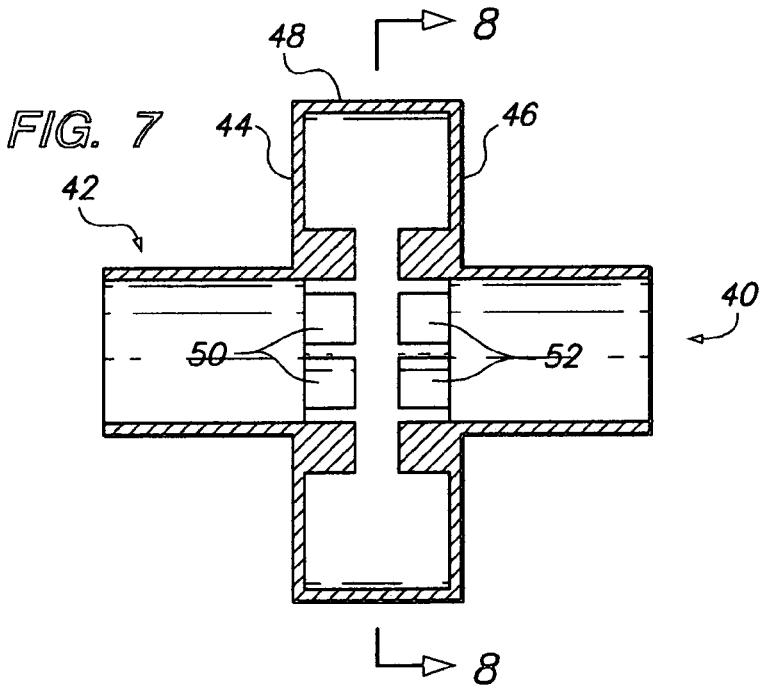
FIG. 7 is a side view in cross section of the cavity of FIG. 6.
Figure 8:
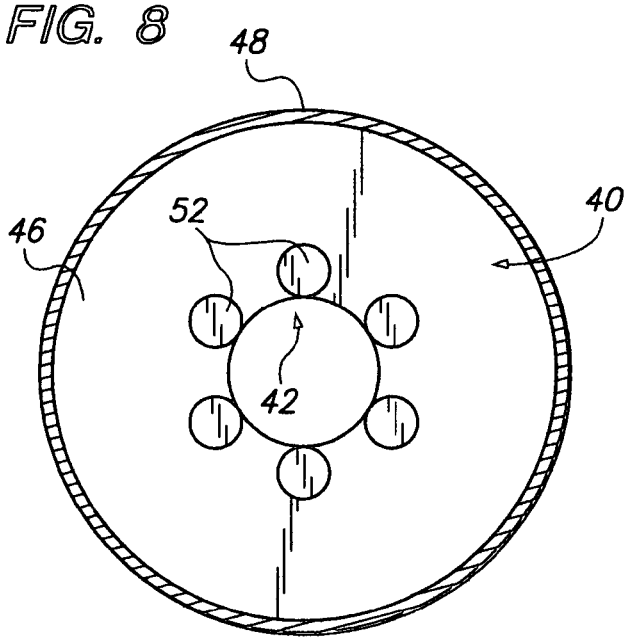
FIG. 8 is an end view in cross section of the cavity of FIG. 6.

FIGS. 6 through 8 disclose a second preferred embodiment of the invention. As in the embodiment described above, a resonant cavity 40 is interposed in a beam tube 42 and includes end walls 44 and 46 connected by cylindrical wall 48. However this embodiment includes six identical rods 50 which extend inwardly from end wall 44, and six opposing rods 52 which extend inwardly from end wall 46. As in the previous embodiment, the rods 50 and 52 are positioned tangentially to the beam tube 42 and are equally spaced azimuthally around the beam tube 42. The six sets of opposing, spaced rods 50 and 52 form a sextupole resonant cavity. A sextupole mode enables detection of an asymmetric component of the beam distribution. One application of such an embodiment is to detect the presence of a beam tail, for providing an early warning of beam breakup due to short-range wakes in a linear accelerator.

The embodiment of FIGS. 6 through 8 consists of a cavity geometry with a 1.0 cm cavity length, a 1.7 cm outer radius and rods each having a diameter of 3 mm and a length of 3 mm, spaced at 60 degree intervals around the cavity and positioned tangentially to the beam tube having a radius of 5 mm. The resonant frequency of this cavity is 14.28 GHz. The shunt impedance near the axis is given by:

$$R(x,y)=11.15(x^3-3xy^2)^2\ \Omega$$

where distances x and y are measured in mm. For the purpose of comparing to a similar cavity with no rods, comparison can be made to a standing-wave cavity operating in the 3 $\pi/4$-mode. With a cavity length of 11 mm, longitudinal centers spaced 13.1 mm apart, and a beam pipe tube with a diameter of 1 cm, the combined shunt impedance for two cells (one active and one inactive) is determined to be 0.45 Ω at a 1 mm offset. By comparison, the shunt impedance for the same cavity but with the six rods is approximately 25 times larger, and the R/Q ratio is approximately 70 times larger. These enhancements are significant and can be combined with the use of multiple cavities and further optimization of the beam tube radius. Such measures can partially overcome the inherently lower sensitivity of a sextupole mode cavity.

The cavity geometries described above offer improved shunt impedance for the measurement of beam quadrupole, sextupole, and higher order moments. These geometries also have advantages in that the remaining cavity modes can be spaced further apart from the mode of interest.

Figure 9:
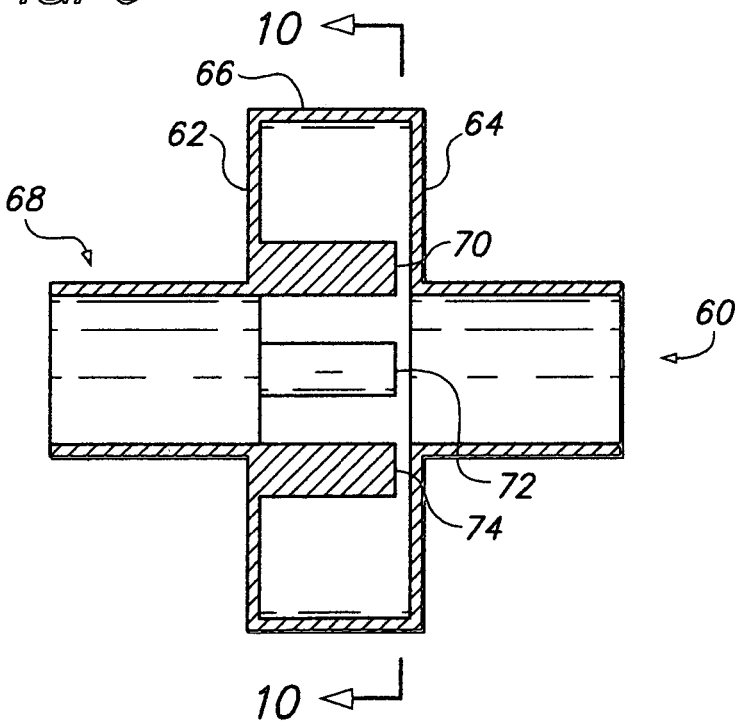
FIG. 9 is a side view in cross section of another embodiment of the invention having four rods that extend from only one end of the cavity, for a distance nearly equal to the length of the cavity.
Figure 10:
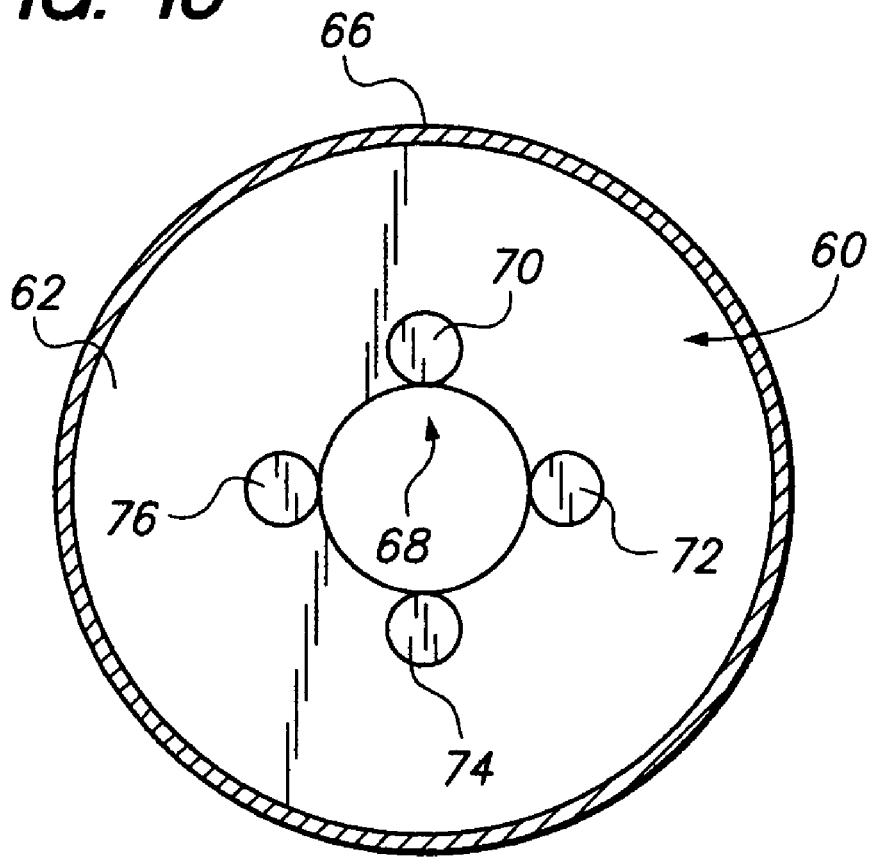
FIG. 10 is an end view in cross section of the embodiment shown in FIG. 9.

FIGS. 9 and 10 illustrate another preferred embodiment of the invention. A resonant cavity 60 having end walls 62 and 64 connected by a cylindrical wall 66 is interposed in a beam tube 68. Four elongated rods 70, 72, 74 and 76 extend inwardly from end wall 62 for a distance greater than the major length of the cavity 60, as measured by the distance between end walls 62 and 64, but less than the length of the cavity 60, so as to provide a capacitative gap between the exposed ends of the rods 70 through 76 and the end wall 64. In the preferred embodiment the length of the rods 70–76 is approximately 90 percent of the length of the cavity 60. As with the previous embodiments, the rods 70 through 76 are positioned tangentially to the beam tube 68 and are spaced equidistantly around the beam tube 68.

Although the present invention is directed to optimizing a design with a 1 cm diameter beam tube resonating at 11.424 GHz, it may be adapted to other operating conditions. The invention can be adapted to a different frequency by proportionally scaling all the structural dimensions, including the beam tube, where the frequency is inversely proportional to the scaled dimension. In this regard the performance of the cavity varies rapidly with the diameter of the beam tube. For example, in the case of an accelerator with an 8 mm beam tube diameter, the shut impedance R is improved by a factor of 2.1 over the 1 cm beam tube embodiment, and in the case of a beam tube having a 1.2 cm diameter the shut impedance is decreased by a factor of 1.8 relative to the 1 cm beam tube embodiment.

The present invention is described and illustrated herein with reference to preferred embodiments that constitute the best mode known to the applicant for making and using the invention. It will be appreciated that various modifications, alterations and substitutions may be apparent to one skilled in the art and may be made without departing from the invention. Accordingly the scope of the invention is defined by the following claims.

The embodiments of the invention in which patent protection is claimed are defined as follows:

1. A diagnostic resonant cavity for use in determining characteristics of a charged particle beam traveling along a beam line of a charged particle accelerator, comprising two electrically conductive opposing end walls spaced apart from one another by an electrically conductive tubular wall, said end walls having openings centered therein for interposition of the cavity in the beam line by connection of said end walls to a beam tube having a central longitudinal axis defining the nominal path of travel of the charged particle beam, and an even plurality of at least four pairs of electrically conductive rods extending into said cavity from said end walls, each of said pairs of rods consisting of two rods extending inwardly and coaxially toward one another from said two opposing end walls and extending parallel to said central longitudinal axis said of said beam tube, said two rods of each pair of opposing rods being spaced from one another so as to form a capacitative gap between one another, and wherein said pairs of rods are equally spaced azimuthally in a symmetrical array around said central longitudinal axis of said beam tube.

2. The diagnostic resonant cavity defined in claim 1 wherein said end walls are each substantially planar and extend parallel to one another.

3. The diagnostic resonant cavity defined in claim 2 wherein said end walls are each orthogonal to said central longitudinal axis of said beam tube.

4. The diagnostic resonant cavity defined in claim 3 wherein said tubular wall of said diagnostic resonant cavity is cylindrical.

5. The diagnostic resonant cavity defined in claim 4 wherein said rods extend from said end walls from points contiguous to said openings in said end walls.

6. The diagnostic resonant cavity defined in claim 5 wherein said rods extend tangentially to said openings in said end walls.

7. The diagnostic resonant cavity defined in claim 6 comprising four pairs of rods to enhance the shunt impedance of the quadrupole resonant mode of the cavity.

8. The diagnostic resonant cavity defined in claim 6 comprising, six pairs of rods to enhance the shunt impedance of the sextupole resonant mode of the cavity.

9. The diagnostic resonant cavity defined in claim 1 comprising four pairs of rods to enhance the shunt impedance of the quadrupole resonant mode of the cavity.

10. The diagnostic resonant cavity defined in claim 1 comprising six pairs of rods to enhance the shunt impedance of the sextupole resonant mode of the cavity.

11. A diagnostic resonant cavity for use in determining characteristics of a charged particle beam traveling along a beam line of a charged particle accelerator, comprising first and second electrically conductive opposing end walls spaced apart from one another by an electrically conductive tubular wall, said end walls having openings centered therein for interposition of the cavity in the beam line by connection of said end walls to a beam tube having a central longitudinal axis defining the nominal path of travel of the charged particle beam, and an even plurality of at least four electrically conductive rods extending into said cavity from said first end wall, each of said rods extending inwardly in a direction parallel to said central longitudinal axis said of said beam tube, and each of said rods having an end distal from said first end wall, said distal end of each rod being spaced from said second end wall so as to form a capacitative gap between the rod and said second end wall, and wherein said rods are equally spaced azimuthally in a symmetrical array around said central longitudinal axis of said beam tube.

12. The diagnostic resonant cavity defined in claim 11 wherein each of said rods extends a distance greater than the major length of said cavity along said axis of said beam tube.

13. The diagnostic resonant cavity defined in claim 12 wherein said tubular wall of said cavity is cylindrical in cross section.

14. The diagnostic resonant cavity defined in claim 13 comprising four rods to enhance the shunt impedance of the quadrupole resonant mode of the cavity.

15. The diagnostic resonant cavity defined in claim 13 comprising six rods to enhance the shunt impedance of the sextupole resonant mode of the cavity.

16. The diagnostic resonant cavity defined in claim 11 wherein said rods extend tangentially to said openings in said end walls.

* * * * *